US009451373B2

(12) United States Patent
Rasmussen

(10) Patent No.: US 9,451,373 B2
(45) Date of Patent: Sep. 20, 2016

(54) EAR DOCKING STATION FOR HEARING AIDS

(71) Applicant: Oticon A/S, Smørum (DK)

(72) Inventor: Karsten Bo Rasmussen, Smørum (DK)

(73) Assignee: OTICON A/S, Smorum (DK)

( * ) Notice: Subject to any disclaimer, the term of this patent is extended or adjusted under 35 U.S.C. 154(b) by 0 days.

(21) Appl. No.: 13/678,605

(22) Filed: Nov. 16, 2012

(65) Prior Publication Data

US 2013/0129130 A1 May 23, 2013

Related U.S. Application Data

(60) Provisional application No. 61/560,821, filed on Nov. 17, 2011.

(30) Foreign Application Priority Data

Nov. 17, 2011 (EP) ..... 11189534

(51) Int. Cl.
*H04R 25/00* (2006.01)

(52) U.S. Cl.
CPC ..... *H04R 25/556* (2013.01); *H04R 25/652* (2013.01); *H04R 25/656* (2013.01); *H04R 2460/17* (2013.01)

(58) Field of Classification Search
CPC .... H04R 25/00; H04R 25/02; H04R 25/652; H04R 2225/023; H04R 2225/025; H04R 2225/67
USPC ..... 381/312–331, 380
See application file for complete search history.

(56) References Cited

U.S. PATENT DOCUMENTS

| | | | | |
|---|---|---|---|---|
| 5,654,530 | A | 8/1997 | Sauer et al. | |
| 6,094,494 | A | 7/2000 | Haroldson | |
| 8,061,472 | B2 * | 11/2011 | Tiemens | A61F 11/08 181/135 |
| 8,189,845 | B2 * | 5/2012 | Mulvey | H04R 1/1016 381/328 |
| 8,340,335 | B1 * | 12/2012 | Shennib | H04R 25/60 381/315 |
| 8,538,055 | B2 * | 9/2013 | Shennib | H04R 25/60 381/324 |
| 2001/0043708 | A1 * | 11/2001 | Brimhall | H04R 25/456 381/328 |
| 2005/0031145 | A1 * | 2/2005 | Maltan | H04R 25/505 381/312 |
| 2007/0223759 | A1 | 9/2007 | Ach-Kowalewski | |
| 2009/0169039 | A1 * | 7/2009 | Rasmussen | H04R 25/652 381/322 |
| 2011/0286616 | A1 * | 11/2011 | Beck | H04R 25/554 381/315 |

FOREIGN PATENT DOCUMENTS

| | | | |
|---|---|---|---|
| DE | 19504478 | A1 | 8/1996 |
| DE | 19943809 | A1 | 3/2001 |
| DE | 10236134 | C1 | 10/2003 |
| DE | 102006014023 | A1 | 10/2007 |
| DE | 102010019710 | A1 | 10/2011 |
| WO | WO 99/07182 | A2 | 2/1999 |
| WO | WO 2011138133 | A1 * | 11/2011 |

* cited by examiner

*Primary Examiner* — Matthew Eason
(74) *Attorney, Agent, or Firm* — Birch, Stewart, Kolasch & Birch, LLP

(57) ABSTRACT

Hearing aid fixture adapted to remain firmly and completely within an external ear canal of a user allowing for an acoustically active part of a hearing aid to be releasably fastened thereto.

28 Claims, 2 Drawing Sheets

EAR DOCKING STATION FOR HEARING AIDS

CROSS REFERENCE TO RELATED APPLICATIONS:

This nonprovisional application claims the benefit under 35 U.S.C. §119(e) of U.S. Provisional Application No. 61/560,821 filed on Nov. 17, 2011 and under 35 U.S.C. §119(a) of patent application Ser. No. 11189534.8 filed in Europe on Nov. 17, 201. The entire content of all of the above applications is hereby incorporated by reference.

BACKGROUND OF THE INVENTION

The invention is related to the field of hearing aids, more specifically to hearing aids sealing the bony part of an external ear canal and the comfort of inserting and wearing them.

Comfortable insertion and safe fixation of an acoustically active part (end portion of a hearing aid tube through which the sound exits) of a bony seal hearing aid is crucial for customer acceptance. Prior art bony seal hearing aids comprise dome portions made of materials such as memory foam, silicon or alike to keep an acoustically active part in place while sealing the external ear canal. It has been observed that such materials, especially if worn on a long term basis, may cause skin irritations in the external ear canal of a user.

An arrangement keeping an acoustically active part of a hearing aid in place is disclosed in DE 102 36 134 C1, namely a hearing aid comprising an implanted acoustic duct extending from behind the ear into the external ear canal of a user, wherein the hearing aid is connected to the acoustic canal via an adapter located behind the ear. With an acoustic duct implanted and requiring an adapter to be placed behind the ear, said arrangement lacks comfort in wear.

A hearing aid enclosed in an ear mold and including an acoustic tube located at its inner end is disclosed in DE 199 43 809 A1. The acoustic tube being connected to an extending component occupying a volume towards the eardrum adapted to shape the acoustic proportions of the hearing aid, the arrangement is not suitable for safely fixing the acoustically active part to the external ear canal.

It is therefore an object of the present invention to provide a means which allows comfortable insertion and safe fixation of an acoustically active bony seal hearing aid.

SUMMARY OF THE INVENTION

According to a first aspect of the present invention, the technical objective is achieved by a hearing aid fixture which is adapted to remain firmly and completely within an external ear canal of a user allowing for an acoustically active part of a hearing aid to be releasably fastened thereto.

The inventive hearing aid fixture allows for an acoustically active part of a hearing aid to be inserted into an external ear canal comfortably by avoiding dome portions made of skin irritating materials. Since the hearing aid fixture remains firmly within the external ear canal, so does the acoustically active part attached thereto. When fastened to the hearing aid fixture the acoustically active part resides within the external ear canal without any direct contact to the external ear canal.

Adapted to remain firmly connotes that the hearing aid fixture is fitted into an external ear canal of a user such that it remains in position when an acoustically active part of a hearing aid which is releasably fastened thereto, is unfastened, i.e. pulled out of the external ear canal of the user.

In a preferred embodiment the hearing aid fixture comprises an ear canal abutting surface defining a first mechanical interface providing for a retaining force between the hearing aid fixture and an ear canal when the hearing aid fixture is inserted in the ear canal. The hearing aid fixture further comprises a second mechanical interface adapted to connect to an acoustically active part of a hearing aid and providing a connection force between an acoustically active part of a hearing aid and the hearing aid fixture. The retaining force is higher than the connection force.

In a preferred embodiment, to prevent ambient noise from reaching the eardrum, the hearing aid fixture but for a comprised auditory duct seals the external ear canal entirely. The hearing aid fixture can be adapted to seal the external ear canal entirely if an acoustically active part of a hearing aid is fastened thereto. The hearing aid fixture can be shaped in a manner of a hollow cylinder with the auditory duct being the inner cylinder.

Preferably, the auditory duct is designed to allow sound from an acoustically active part to reach the ear drum. To further improve sound transfer through the hearing aid fixture, the auditory duct can be adapted to accommodate a protruding portion of an acoustically active part of a hearing aid. The auditory duct can extend centrally through the hearing aid fixture along an axis of insertion to prevent misplacement of an acoustically active part to be attached.

In a preferred embodiment the hearing aid fixture is adapted to allow for an acoustically active part of a hearing aid to be magnetically fastened thereto. This prevents abrasion from both the hearing aid fixture and the acoustically active part. The respective magnetic components can be placed at the fixture and/or the acoustically active part such that the magnetic fastening is self-centering, that means that when inserted the acoustically active part is guided toward an optimal position.

In a further preferred embodiment the hearing aid fixture comprises a slit. The slit is formed as part of the auditory duct. The slit extends from a front face portion to an end face portion and/or along an ear canal abutting surface of the hearing aid fixture. The slit is provided in the hearing aid fixture such that the hearing aid fixture can resiliently extend in diameter to provide entry for an acoustically active part of a hearing aid. When in position the hearing aid fixture returning to its original diameter can provide for a mechanical locking. To provide a simple and robust mechanism, the mechanical locking is preferably of force fitting nature.

The slit can be provided in the hearing aid fixture such so as to allow for the hearing aid fixture to be resiliently squeezed from a firmly fitting diameter to a lesser diameter to simplify insertion of the hearing aid fixture. Such simplified insertion causes lesser skin pressure in the external ear canal.

To prevent debris entering the hearing aid fixture through said slit, the hearing aid fixture can comprises a plate covering the slit in the directing of insertion. The plate can be attachable to or formed as part of an acoustically active part of a hearing aid. In a preferred embodiment the plate is adapted to span a cross section of an external ear canal lying perpendicular to the direction of insertion. Thereby additional sealing of the auditory duct is achieved.

To be even more subtle to allow being placed close to the ear drum the length of the hearing aid fixture in the direction of insertion can be less than its diameter perpendicular to the direction of insertion.

In a preferred embodiment the hearing aid fixture is made of a shape-retaining material. This allows for the ear canal of a user to adapt more easily to the hearing aid fixture to be worn on a long term basis. At least ear canal abutting surface of the hearing aid fixture in physical contact with the external ear canal of a user can be made of or coated with a biocompatible material (material with high skin tolerance), such as titanium or alike. This allows for the hearing aid to remain in the ear canal for weeks or month or even permanently. This is true for the hearing aid fixture with or without the acoustically active part fastened thereto.

In a further preferred embodiment, to reduce a customizing effort, the hearing aid fixture is chosen from a range of pre-manufactured sizes as to fit firmly and completely within an external ear canal of a user.

According to a second aspect of the present invention, the technical object is achieved by a hearing aid assembly comprising a hearing aid fixture and an acoustically active part of a hearing aid releasably fastened thereto. It is to be understood that the embodiments and advantages described with respect to the first aspect of the present invention are comprised by the second aspect of the invention as well.

DETAILED DESCRIPTION

Figure 1:
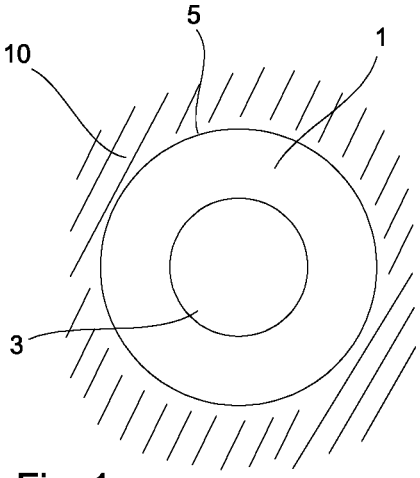
FIG. 1 schematically depicts a cross section of an ear canal perpendicular to the direction of insertion with a hearing aid fixture according to a first embodiment of the invention.
Figure 2:
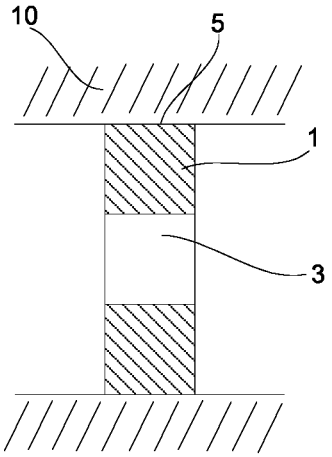
FIG. 2 schematically depicts a side view of the hearing aid fixture of FIG. 1.

A hearing aid fixture 1 in FIG. 1 and FIG. 2 is fitted firmly within an external ear canal 10 of a user. The hearing aid fixture 1 comprises an auditory duct 3 extending centrally through the hearing aid fixture 1 along an axis of insertion. The hearing aid fixture 1 is shaped in a manner of a hollow cylinder with the auditory duct 3 being the inner cylinder. The hearing aid fixture 1 seals the external ear canal 10 entirely but for auditory duct 3. An ear canal abutting surface 5 of the hearing aid fixture 1 in physical contact with the external ear canal 10 of a user is made of titanium. The ear canal abutting surface 5 defines a first mechanical interface providing for a retaining force between the hearing aid fixture 1 and the ear canal 10 when the hearing aid fixture 1 is inserted in the ear canal. As can be seen from FIG. 2 the hearing aid fixture 1 is fitted completely within the external ear canal 10.

Figure 3:
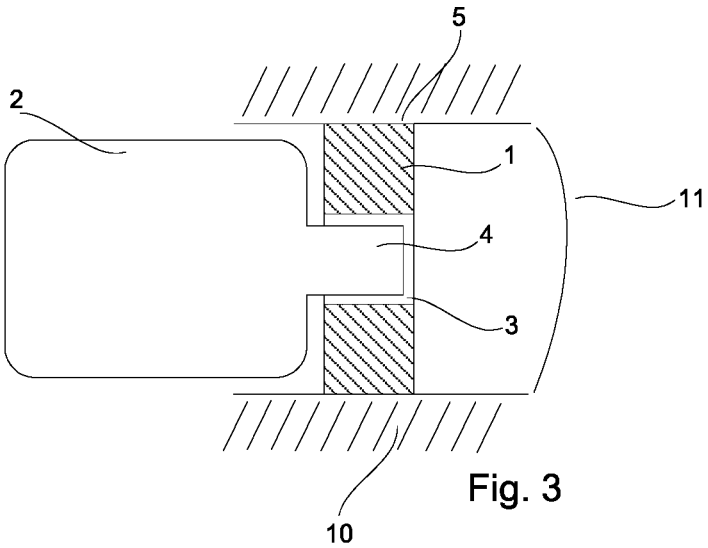
FIG. 3 schematically depicts the hearing aid fixture of FIG. 1 with an acoustically active part of a hearing aid releasably fastened thereto forming a hearing aid assembly.

FIG. 3 depicts a hearing aid assembly, comprising a hearing aid fixture 1 as of FIG. 1 and FIG. 2 and an acoustically active part 2 of a hearing aid releasably fastened thereto. The auditory duct 3 is adapted to accommodate a protruding portion 4 of the acoustically active part 2. The hearing aid fixture 1 seals the external ear canal 10 entirely since the acoustically active part 2 is fastened thereto. The acoustically active part 2 is magnetically fastened to the hearing aid fixture 1 (magnetic members not shown). The magnetic members define a second mechanical interface with a connection force between the acoustically active part 2 of a hearing aid and the hearing aid fixture 2. The retaining force provided by the first mechanical interface is higher than the connection force provided by the second mechanical interface. The length of the hearing aid fixture 1 in the direction of insertion is less than its diameter perpendicular to the direction of insertion. The hearing aid fixture 1 is placed close to eardrum 11.

Figure 4:
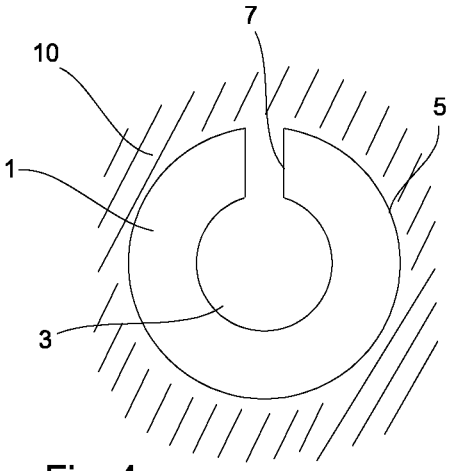
FIG. 4 schematically depicts a cross section of an ear canal perpendicular to the direction of insertion with a hearing aid fixture according to a second embodiment of the invention.
Figure 5:
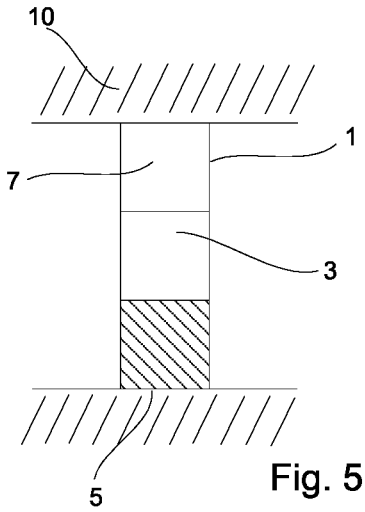
FIG. 5 schematically depicts a side view of the hearing aid fixture of FIG. 4.

A hearing aid fixture 1 in FIG. 4 and FIG. 5 is fitted firmly within an external ear canal 10 of a user. The hearing aid fixture 1 comprises an auditory duct 3 extending centrally through the hearing aid fixture 1 along an axis of insertion. The hearing aid fixture 1 is shaped in a manner of a hollow cylinder with the auditory duct 3 being the inner cylinder. The hearing aid fixture 1 comprises a slit 7 as part of the auditory duct 3. The slit 7 allows for the hearing aid fixture 1 to be squeezed in a spring-like manner from a firmly fitting diameter (as shown in FIG. 4 and FIG. 5) to a lesser diameter (not shown) to simplify insertion. The hearing aid fixture 1 seals the external ear canal 10 entirely but for auditory duct 3 (and slit 7 as part of the auditory duct 3). An ear canal abutting surface 5 of the hearing aid fixture 1 in physical contact with the external ear canal 10 of a user is made of titanium. As can bee seen from FIG. 2 the hearing aid fixture 1 is fitted completely within the external ear canal 10.

Figure 6:
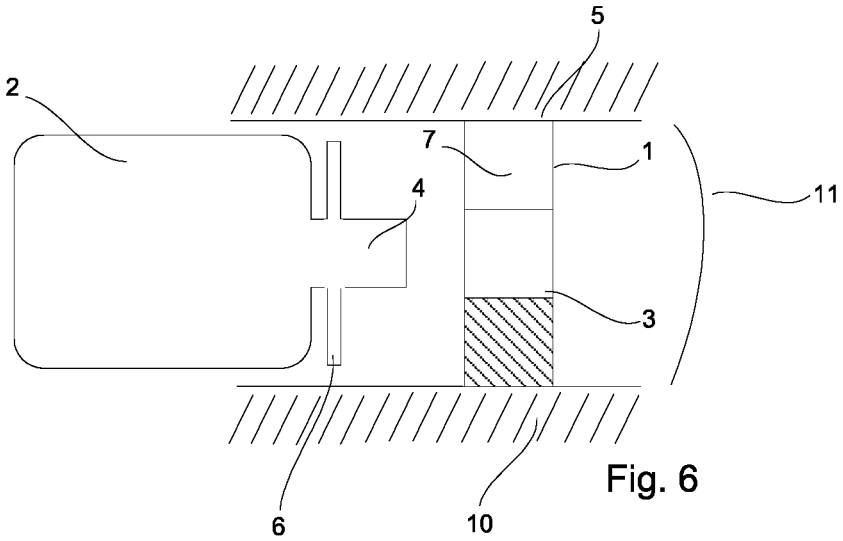
FIG. 6 schematically depicts the hearing aid fixture of FIG. 5 with an acoustically active part of a hearing aid releasably fastened thereto forming a hearing aid assembly.

FIG. 6 depicts a hearing aid assembly, comprising a hearing aid fixture 1 as of FIG. 3 and FIG. 4 and an acoustically active part 2 of a hearing aid about to be releasably fastened thereto. The auditory duct 3 of hearing aid fixture 1 is adapted to accommodate a protruding portion 4 of the acoustically active part 2. The auditory duct 3 coincidently defines a second mechanical interface adapted to connect to the protruding portion 4 of the acoustically active part 2 of a hearing aid. The retaining force provided by the first mechanical interface is higher than the connection force provided by the second mechanical interface. Slit 7 comprised by hearing aid fixture 1 extend from a front face portion to an end face portion and along ear canal abutting surface 5. The ear canal abutting surface 5 defines a first mechanical interface providing for a retaining force between the hearing aid fixture 1 and ear canal 10 when the hearing aid fixture 1 is inserted in the ear canal. Slit 7 allows for the hearing aid fixture to resiliently expand in diameter to provide entry for an acoustically active part 2 and its force fitting locking thereafter. The hearing aid assembly comprises a plate 6 adapted to cover the slit 7 once as the acoustically active part 2 arrives in its attached position. The plate 6 is formed as part of the acoustically active part 2. Furthermore, plate 6 is adapted to span a cross section of an external ear canal lying perpendicular to the direction of insertion to provide for additional sealing of the auditory duct 3. The length of the hearing aid fixture 1 in the direction of insertion is less than its diameter perpendicular to the direction of insertion.

The invention claimed is:

1. Hearing aid fixture adapted to remain firmly and completely within an ear canal of a user allowing for an acoustically active part of a hearing aid to be releasably fastened to the hearing aid fixture, while the hearing aid fixture remains in the ear canal, the hearing aid fixture comprising:

an auditory duct;

a slit as part of the auditory duct, the slit adapted to allow for the hearing aid fixture to be resiliently squeezed from a firmly fitting diameter to a lesser diameter to simplify insertion and/or for the hearing aid fixture to resiliently expand in diameter to provide entry for an acoustically active part and its mechanical locking thereafter, wherein the hearing aid fixture presses against the ear canal except in the area of the slit.

2. Hearing aid fixture according to claim 1, further comprising:

an ear canal abutting surface defining a first mechanical interface providing for a retaining force between the hearing aid fixture and an ear canal when the hearing aid fixture is inserted in the ear canal; and a second mechanical interface adapted to connect to the acoustically active part of the hearing aid and providing a connection force between the acoustically active part of the hearing aid and the hearing aid fixture wherein the retaining force is higher than the connection force.

3. Hearing aid fixture according to claim 1, wherein the auditory duct is adapted to accommodate a protruding portion of the acoustically active part of the hearing aid and thus defines a mechanical interface between the hearing aid fixture and the acoustically active part of the hearing aid.

4. Hearing aid fixture according to claim 1, wherein the auditory duct extends centrally through the hearing aid fixture along an axis of insertion.

5. Hearing aid fixture according to claim 1, wherein the hearing aid fixture is adapted to seal the ear canal entirely if the acoustically active part of the hearing aid is fastened thereto.

6. Hearing aid fixture according to claim 1, wherein the hearing aid fixture is adapted to allow for the acoustically active part of the hearing aid to be magnetically fastened thereto.

7. Hearing aid fixture according to claim 1, further comprising:

a plate covering the slit in the directing of insertion, wherein the plate is attachable to or formed as part of the acoustically active part of the hearing aid.

8. Hearing aid fixture according to claim 7, wherein the plate is adapted to span a cross section of the ear canal lying perpendicular to the direction of insertion to provide for additional sealing of the auditory duct.

9. Hearing aid fixture according to claim 1, wherein the hearing aid fixture is made of a shape-retaining material.

10. Hearing aid fixture according to claim 1, wherein at least an ear canal abutting surface of the hearing aid fixture in physical contact with the ear canal of the user is made of or coated with a biocompatible material.

11. Hearing aid fixture according to claim 1, wherein the length of the hearing aid fixture in the direction of insertion is less than its diameter perpendicular to the direction of insertion.

12. Hearing aid fixture according to claim 1, wherein the hearing aid fixture is chosen from a range of pre-manufactured sizes so as to fit firmly and completely within the ear canal of the user.

13. A hearing aid assembly, comprising:

a hearing aid fixture according to claim 1; and an acoustically active part of a hearing aid releasably fastened thereto.

14. A hearing aid fixture adapted to remain firmly and completely within an ear canal of a user allowing for an acoustically active part of a hearing aid to be releasably fastened to the hearing aid fixture, while the hearing aid fixture remains in the ear canal, the hearing aid fixture comprising:

an auditory duct having a shape that is completely filled with the acoustically active part of the hearing aid when the acoustically active part is fastened to the hearing aid fixture;

an ear canal abutting surface defining a first mechanical interface providing for a retaining force between the hearing aid fixture and the ear canal when the hearing aid fixture is inserted in the ear canal; and a hearing aid abutting surface defining a second mechanical interface between a surface of the auditory duct and the acoustically active part of the hearing aid, the second mechanical interface providing a connection force between the acoustically active part of the hearing aid and the hearing aid fixture wherein the retaining force is higher than the connection force.

15. A hearing aid fixture adapted to remain firmly and completely within an ear canal of a user allowing for an acoustically active part of a hearing aid to be releasably fastened to the hearing aid fixture, while the hearing aid fixture remains in the ear canal, the hearing aid fixture comprising:

an annular body;

an auditory duct extending through the annular body and configured to support the acoustically active part of the hearing aid;

an ear canal abutting surface of the annular body defining a first mechanical interface providing for a retaining force between the hearing aid fixture and the ear canal when the hearing aid fixture is inserted in the ear canal; and a second mechanical interface adapted to connect to the acoustically active part of the hearing aid and providing a connection force between the acoustically active part of the hearing aid and the hearing aid fixture wherein the retaining force is higher than the connection force.

16. The hearing aid fixture according to claim 14, wherein the auditory duct is adapted to accommodate a protruding portion of the acoustically active part of the hearing aid and thus defines a mechanical interface between the hearing aid fixture and the acoustically active part of the hearing aid.

17. The hearing aid fixture according to claim 14, wherein the auditory duct extends centrally through the hearing aid fixture along an axis of insertion.

18. The hearing aid fixture according to claim 14, wherein the hearing aid fixture is adapted to seal the ear canal entirely if the acoustically active part of the hearing aid is fastened thereto.

19. The hearing aid fixture according to claim 14, wherein the hearing aid fixture is adapted to allow for the acoustically active part of the hearing aid to be magnetically fastened thereto.

20. The hearing aid fixture according to claim 14, wherein the hearing aid fixture is made of a shape-retaining material.

21. The hearing aid fixture according to claim 14, wherein at least an ear canal abutting surface of the hearing aid fixture in physical contact with the ear canal of the user is made of or coated with a biocompatible material.

22. The hearing aid fixture according to claim 14, wherein the length of the hearing aid fixture in the direction of insertion is less than its diameter perpendicular to the direction of insertion.

23. The hearing aid fixture according to claim 14, wherein the hearing aid fixture is chosen from a range of pre-manufactured sizes so as to fit firmly and completely within the ear canal of the user.

24. A hearing aid assembly, comprising:

a hearing aid fixture according to claim 14; and an acoustically active part of a hearing aid releasably fastened thereto.

25. The hearing aid fixture according to claim 15, wherein the annular body is a hollow cylinder.

26. The hearing aid fixture according to claim 25, wherein the auditory duct has a cylindrical shape.

27. The hearing aid fixture according to claim 1, further comprising:

an ear canal abutting surface defining a first mechanical interface providing for a retaining force between the hearing aid fixture and an ear canal when the hearing aid fixture is inserted in the ear canal.

28. The hearing aid fixture according to claim 27, further comprising:

a second mechanical interface adapted to connect to the acoustically active part of the hearing aid and providing a connection force between the acoustically active part of the hearing aid and the hearing aid fixture wherein the retaining force is higher than the connection force.

* * * * *